US005645445A

United States Patent [19]

Siemon et al.

[11] Patent Number: 5,645,445

[45] Date of Patent: Jul. 8, 1997

[54] WIRE TERMINATION BLOCK

[75] Inventors: John A. Siemon, Woodbury; Howard Reynolds, Plainville, both of Conn.

[73] Assignee: The Siemon Company, Watertown, Conn.

[21] Appl. No.: 272,120

[22] Filed: Jul. 7, 1994

Related U.S. Application Data

[63] Continuation of Ser. No. 932,495, Aug. 20, 1992, abandoned.

[51] Int. Cl.[6] ..... H01R 4/24

[52] U.S. Cl. ..... 439/395; 439/723; 439/751

[58] Field of Search ..... 439/395–405, 439/709, 721–725, 733, 751, 82, 83, 329, 742

[56] References Cited

U.S. PATENT DOCUMENTS

| | | | |
|---|---|---|---|
| 3,725,843 | 4/1973 | Johnson | 339/19 |
| 3,923,362 | 12/1975 | Dunn et al. | 339/96 |
| 4,175,821 | 11/1979 | Hunter | 339/258 R |
| 4,392,701 | 7/1983 | Weidler | 339/17 R |
| 4,475,284 | 10/1984 | Johnson | 29/739 |
| 4,688,865 | 8/1987 | Kelly | 439/79 |
| 4,768,980 | 9/1988 | Collier | 439/751 |
| 4,865,562 | 9/1989 | Burg et al. | 439/395 |
| 4,869,684 | 9/1989 | Cloud et al. | 439/402 |
| 4,909,754 | 3/1990 | Paradis | 439/405 |
| 4,923,414 | 5/1990 | Sitzler | 439/751 |
| 4,964,812 | 10/1990 | Siemon et al. | 439/403 |
| 5,004,426 | 4/1991 | Barnett | 439/82 |
| 5,061,209 | 10/1991 | Bolick, Jr. et al. | 439/676 |
| 5,073,119 | 12/1991 | Soes | 439/82 |

FOREIGN PATENT DOCUMENTS

| | | |
|---|---|---|
| 0327330A2 | 8/1989 | European Pat. Off. . |
| 3831508A1 | 3/1990 | Germany . |

*Primary Examiner*—David L. Pirlot

*Attorney, Agent, or Firm*—Fishman, Dionne, Cantor & Colburn

[57] ABSTRACT

A printed circuit board mountable connecting block of the type described in U.S. Pat. No. 4,964,812 is provided with electrical contacts which include an insulation displacement slot at one end and a circuit mountable tail at the other end. This tail may comprise a conventional solder tail, or in a preferred embodiment, may comprise a "solderless" press-fit tail. The connecting block of this invention may be mounted directly onto (e.g., through) a printed circuit board (or other electronic component). It will be appreciated that this circuit mountable feature is required and advantageous for many applications. In addition, the use of a solderless connector means (preferably a press-fit tail) is particularly advantageous for providing ease of assembly as well as lower cost (relative to conventional solderable tails).

14 Claims, 2 Drawing Sheets

WIRE TERMINATION BLOCK

This is a continuation of application Ser. No. 07/932,495 filed on Aug. 20, 1992 and now abandoned.

BACKGROUND OF THE INVENTION

This invention relates generally to devices for making electrical connections between two sets of conductors. More particularly, this invention relates to connecting devices for use in the communications industry comprising two basic components, namely a wiring block and a connecting block wherein the connecting block includes a novel solderable or press-fittable tail for electrical and physical attachment to circuit board circuitry. Such tails extend from an electrical contact whose opposing end is suitable for the termination of insulated wires.

Wire connecting systems of the type described herein are well known and commercially available from AT&T Technologies as the 110 connector system. 110 type wiring systems are described in several prior patents including U.S. Pat. Nos. 3,611,624; 3,978,587 and 4,118,095.

Wire connecting blocks of the type disclosed in B. C. Ellis, Jr. U.S. Pat. No. 3,611,264 issued Oct. 5, 1971, include an indexing strip (wiring block) and a connecting block, the latter of which carries a plurality of slotted beam contacts. The indexing strip has a plurality of uniform height, spaced-apart teeth along its length. These teeth aid in indexing a first set of conductors. A corresponding plurality of uniform height, spaced-teeth carried by the connecting block serve to index a second set of conductors to be cross-connected through the slotted beam contact to the first set of conductors.

A number of improvements to the basic Ellis, Jr. connecting block are disclosed in B. C. Ellis, Jr. et al U.S. Pat. No. 3,798,587 issued Mar. 19, 1974. In the improved version, the spaced-apart teeth in both the indexing strip and the connecting block are staggered in height to facilitate indexing each set of conductors. The Ellis, Jr. et al connecting block is a two-piece structure comprised of matching halves which are secured together following insertion of the slotted beam contacts. However, it has been found that when the connecting block is placed over the indexing strip in cold temperatures, certain stresses are applied to the bond between the two connector parts. These stresses often rupture the bond causing failure of the entire unit.

The problems associated with U.S. Pat. No. 3,798,587 were improved upon in U.S. Pat. No. 4,118,095 issued Oct. 3, 1978 to Berglund et al. As in U.S. Pat. Nos. 3,611,264 and 3,798,587, Berglund et al relates to a wire connecting block which includes a pair of mating connectors (e.g., connecting block and wiring block) for effecting electrical cross-connections between a first set of conductors and a second set of conductors. The first connector indexes the first conductors and holds them in alignment for engagement with a plurality of insulation-penetrating slotted beam contacts carried by the second connector.

Rather than the connecting block comprising two substantially matching halves as in U.S. Pat. No. 3,798,587, in the Berglund et al patent, the connecting block comprises a housing which mates with a discrete anchoring member. The separate anchoring member is a molded piece which acts to position and retain the plurality of spaced beam contacts.

While the use of the housing/anchoring member presents an improvement to the structure of U.S. Pat. No. 3,798,587, the Berglund et al structure nevertheless suffers from certain deficiencies and drawbacks. For example, the connecting block of Berglund et al is still comprised of two discrete molded parts (e.g., the housing member and the anchoring member). The use of the second molded part (e.g., anchoring member) to hold in contacts increases assembly time, inventory, tooling cost and, consequently, the overall cost of the part to the end user. In addition, the second molded part (e.g., anchoring member) may be removed (for example, due to a faulty ultrasonic weld) thereby destroying the connector assembly.

Another detrimental characteristic of prior art connecting blocks described in U.S. Pat. Nos. 3,611,264; 3,798,387 and 4,118,095 results from the requirement that they be continuously end stackable on the wiring block. Because the existing embodiments or prior art designs preserve the contact center spacing to maintain precise alignment with the mating receptacles on the wiring block, the resulting insulating barrier that confines the outside surfaces of the end contacts is thin, and therefore prone to breakage when required to terminate the large wire gauges (e.g., 22 AWG wire) presently in use for data transmission applications. When such breakage occurs on the ends of adjacent connecting block modules, electrical shorting results.

U.S. Pat. No. 4,964,812, which is assigned to the assignee hereof and incorporated herein by reference, provides significant improvements to the above-discussed connecting blocks. In accordance with U.S. Pat. No. 4,964,812, a wire connecting system is provided which includes a pair of mating connectors for effecting electrical cross connections between a first set of conductors and a second set of conductors. The two mating connectors are known by the terms "wiring block" and "connecting block" wherein the wiring block provides evenly spaced receptacles for the first wire conductors that hold them in alignment for engagement with a plurality of insulation penetrating slotted beam contacts carried by the connecting block.

In accordance with an important feature of U.S. Pat. No. 4,964,812, the connecting block employs a novel one piece structure which both forms the connector block housing as well as provides retention means for positioning and retaining the slotted beam contacts. These retention means comprise retention posts which are flash molded onto the side of the connecting block during the molding operation. Upon insertion and positioning of a plurality of beam contacts within the connecting block housing, pressure is exerted against the retention posts thereby breaking the flash molding and forcing the posts through positioning holes in the contacts. Thereafter, the post tips are peened in place providing permanent but free floating connection between the contacts and the connecting block housing.

The use of the one-piece housing thereby overcomes the several deficiencies and disadvantages relative to the two-piece connecting block structures associated with the prior art; and thus decreases assembly time, inventory and tooling costs leading to an overall lower cost for the connecting block portion of the electrical wiring system.

The connecting block of U.S. Pat. No. 4,964,812 also overcomes the problem of inadequate end wall strength discussed above by making use of the free floating contact retention inherent to both the present invention and prior art designs. This improvement is accomplished by employing irregular contact spacing on the end positions of the connecting block module. As a result, the tendency for outside wall breakage is substantially reduced. Reduction in center spacing for the two end contact problems (typically by about "0.005 per side) allows for an increase in outside wall thickness by approximately 30% while also acting to inwardly bias the upper halves of the outside contact when mated with the wiring block. The free floating nature of the terminal clips easily allows for the non-cumulative spacing deviation between the outer two positions of the connecting block and wiring block without compromising connection integrity or compatibility with accessories common to both the present invention and prior art designs.

While well-suited for its intended purpose, there are many applications which necessitate that the connecting block be connected directly to a circuit board (or the like) as opposed to the receptacles of the wiring block. While connecting blocks of the type disclosed by in Berglund patent 4,118,095 are known which include a tail extension for soldering onto a circuit board (referred to as AT&T 110D Modules), there is presently no circuit mountable connecting block of the type described in U.S. Pat. No. 4,964,812.

SUMMARY OF THE INVENTION

The above-discussed and other drawbacks and deficiencies of the prior art are overcome or alleviated by the printed circuit board mountable connecting block of the present invention. In accordance with the present invention, a connecting block of the type described in U.S. Pat. No. 4,964,812 is provided with electrical contacts which include an insulation displacement slot at one end and a circuit mountable tail at the other end. This tail may comprise a conventional solder tail, or in a preferred embodiment, may comprise a "solderless" press-fit tail.

The connecting block of this invention may be mounted directly onto (e.g., through) a printed circuit board (or other electronic component). It will be appreciated that this circuit mountable feature is required and advantageous for many applications. In addition, the use of a solderless connector means (preferably a press-fit tail) is particularly advantageous for providing ease of assembly as well as lower cost (relative to conventional solderable tails). The use of solderless connector means, in the present invention, allows lower cost housing materials to be employed, since these housing materials are not exposed to the extreme heat and aggresive solvents typically encountered with soldered connections. Two embodiments for press-fit tails are disclosed including a "C" shaped tail and a "Needle's Eye" shaped tail.

The above-discussed and other features and advantages of the present invention will be appreciated and understood by those of ordinary skill in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
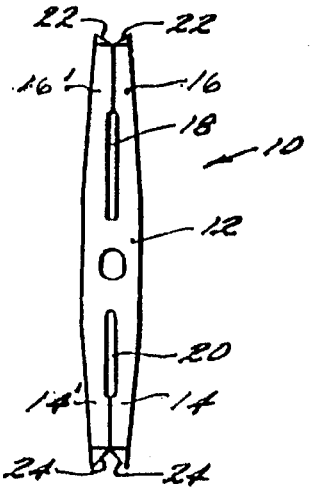
FIG. 1 (PRIOR ART)
FIG. 1 is a front elevation view of a beam contact in accordance with prior art U.S. Pat. No. 4,964,812.

Referring to FIG. 1, a beam contact in accordance with U.S. Pat. No. 4,964,812 is shown generally at 10. Contact 10 includes a central portion 12 which has first and second pairs of oppositely directed cantilever beams 14, 14' and 16, 16' extending therefrom. Each of the pairs of beams 14, 14' and 16, 16' are spaced apart from one another by elongated generally rectangular openings 18 and 20, respectively. Openings 18 and 20 extend from central portion 12 to a point near a pair of oppositely directed insulation, penetrating edges 22 and 24, respectively at the ends of beams 14, 14' and 16, 16'.

Figure 2:
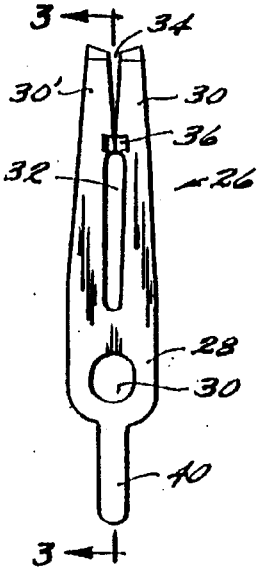
FIG. 2 is a front elevation view of a first embodiment of a solder tail beam contact in accordance with the present invention.
Figure 3:
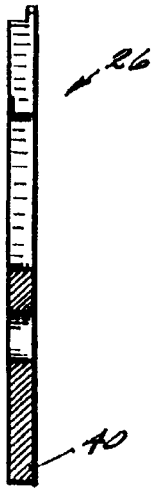
FIG. 3 is a cross-sectional elevation view along the line 3—3 of FIG. 2.
Figure 4A:
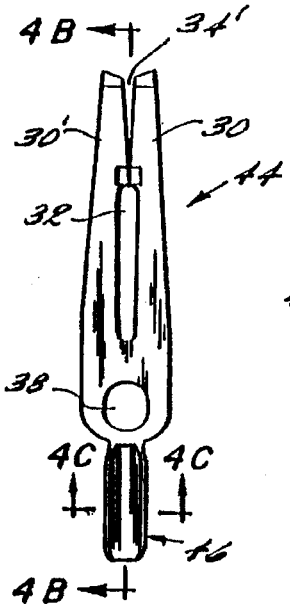
FIG. 4A is a front view, similar to FIG. 2 of an alternative press-fit tail configuration of the beam contact of this invention.
Figure 4B:
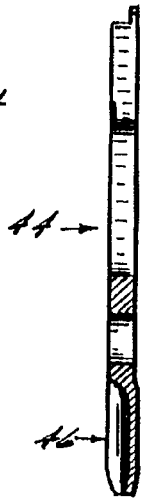
FIG. 4B is a cross-sectional elevation view along the line 4B—4B of FIG. 4A.
Figure 4C:
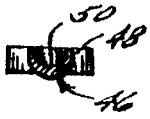
FIG. 4C is a cross-sectional elevation view along the line 4C—4C of FIG. 4A.
Figure 4D:
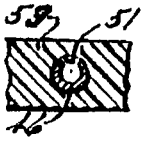
FIG. 4D is a cross-sectional elevation view, similar to FIG. 4C, but subsequent to being press-fit into a printed circuit board.
Figure 12:
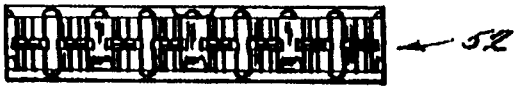
FIG. 12 is a top plan view of the block of FIG. 9.
Figure 8:
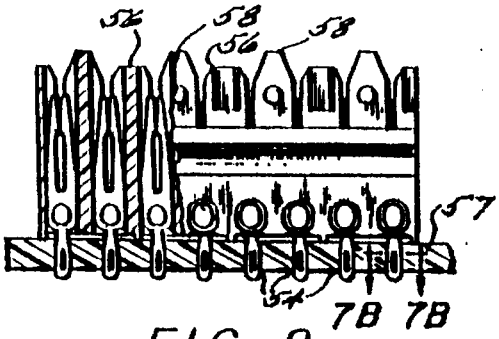
FIG. 8 is a front elevation view of a connector block in partial cross-section assembled to a circuit board in full cross-section in accordance with the present invention.
Figure 10:
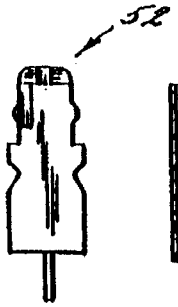
FIG. 10 is a right side view of the block of FIG. 9.
Figure 9:
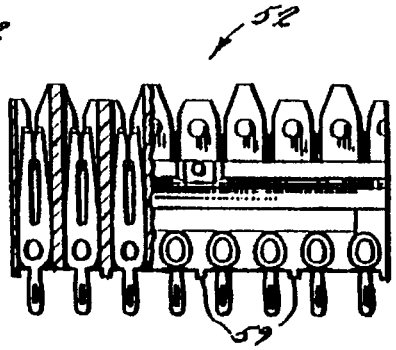
FIG. 9 is a back view of the block of FIG. 8 prior to circuit board assembly in partial cross-section.
Figure 11:
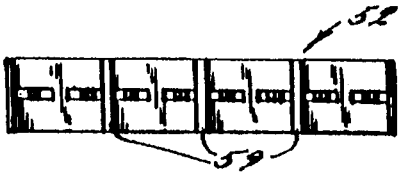
FIG. 11 is a bottom view of the block of FIG. 9.

Turning now to FIGS. 2 and 3, a beam contact in accordance with the present invention is shown generally at 26. Beam contact 26 is similar to prior art beam contact 10 and includes a base 28 from which extends a pair of cantilever beams 30, 30'. An elongated, generally rectangular opening 32 separates beams 30, 30' at a lower portion thereof. In a preferred embodiment, the beams diverge slightly from each other to form a V-shaped entry portion 34. V-shaped opening 34 originates from a coined area 36. The V-shaped opening exposes inner surfaces of beams 30 and 30' in the area of electrical connection so that they may be plated after stamping and forming operations are complete. Base 28 includes an opening 38 therein for receiving a retaining pin from the connector block as is discussed hereinafter. Extending downwardly from base 28 in the direction opposite to beams 30, 30' is a solderable tail 40 which is configured to be received in a throughole of a conventional circuit board and thereafter soldered through the circuit board for connection of terminal clip 26 to a selected circuit line on the circuit board. One preferred embodiment of a beam contact in accordance with the present invention is shown generally at 44 in FIGS. 4A–4C. Beam contact 44 is substantially similar to beam contact 26 with like elements being indicated by the same identification numbers. However, in contrast to beam contact 26, beam contact 40 terminates at solderless connecting means 46 for effecting connection between each beam contact 44 and the throughole of a circuit board. Solderless connecting means 46 comprises a press-fit tail in the form of an elongated arcuate open cylinder with a cross-section in the shape of a "C". This elongated open cylinder includes an outer wall 48 and an inner wall 50 with the thickness between walls 48 and 50 (as best shown in FIG. 4C) being at a maximum at the center to a minimum at the two opposed ends. As a result of this structural configuration, press-fit tail 46 has a resiliency whereby, with reference to FIG. 4D, upon insertion in a plated throughole 51 of a printed circuit board 53, the "C" shape is compressed in such a way as to conform to the circular shape of the throughole thereby urging the tips of the "C" closer together. The elastic characteristics at the contact material cause the "C" shape to maintain outward force on the plated surface of the throughole which in-turn produces an impenetrable electrical interface between the printed circuit board and the beam contact. In many applications, press-fit tail 46 is preferable over solderable tail 40 since the press-fit tail does not require a soldering or other permanent connective step and therefore is less costly from a labor standpoint as well as a materials standpoint. Of course, solderless connector 46 may comprise any other suitable solderless design which will permit a solderless or other type of like connection to a printed circuit board.

Figure 6:
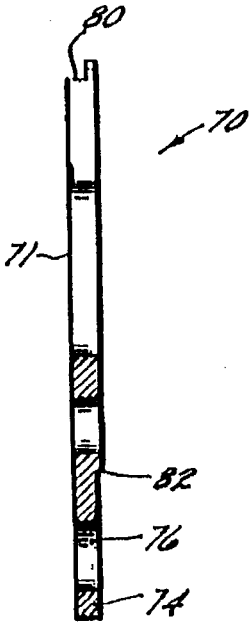
FIG. 6 is a cross-sectional elevation view along the line 6—6 of FIG. 5.

A particularly preferred embodiment of a solderless beam contact is shown at 70 in FIGS. 5–7A. The upper portion 71 (containing insulation displacement slot 34') of beam 70 is substantially similar to beam 44 and therefore no further description is required. The tail portion 72 of beam contact 70 has a shape similar to that of a needle's eye (sometimes referred to as "eye-of-the-needle" and also referred to herein as an eyelet) which comprises an oblong stem (or tail) 74 with an axially aligned, longitudinal inner oblong or lenticular opening 76 through stem 74. As clearly shown FIG. 5, the oblong opening 76 has a shape (prior to stem 74 being press fit through an opening in a circuit board) comprising opposed, parallel, elongated sidewalls of equal length which are interconnected at opposed ends thereof by a pair of opposed semi-circular end walls of equal radius. In the preferred embodiment, the outer opposed edges 78 of stem 74 are coined. In addition, as best shown in FIG. 6, a first coin 80 is provided at the entrance to IDC slot 34' and a second coin 82, axially offset from first coin 80, is provided at the intersection between tail 74 and upper portion 71. These mutually offset coins are positioned on substantially opposite sides of beam contact 70 to generate substantially pure axial forces (as indicated by the arrow identified by "F") during printed circuit board insertion.

Figure 7A:
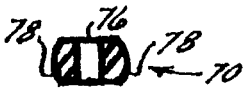
FIG. 7A is a cross-sectional elevation view along the line 7A—7A of FIG. 5.
Figure 7B:
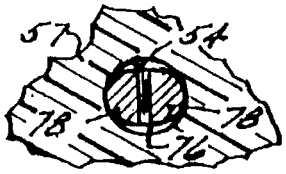
FIG. 7B is a cross-sectional elevation view along the line 7B—7B of FIG. 8.
Figure 8A:
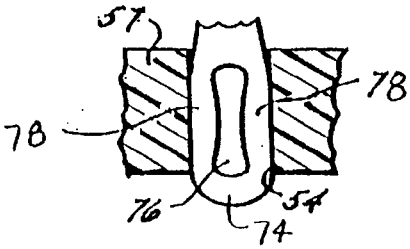
FIG. 8A is an enlarged view of a portion of FIG. 8.
Figure 5:
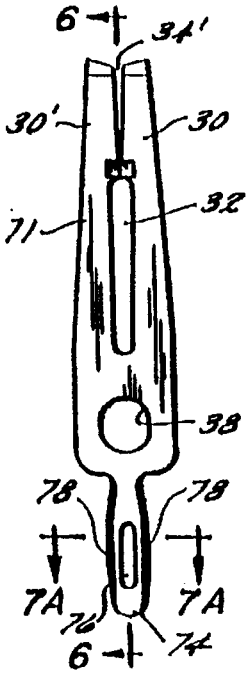
FIG. 5 is a front elevation view of still another press-fit tail embodiment of a beam contact in accordance with this invention.

Turning now to FIGS. 7A–7B and 8A, upon insertion of stem. 74 into the throughole 54 of a circuit board 56, the gap defined by oblong opening 76 is compressed (compare FIGS. 7A–7B) as the opposed resilient side walls 78 of stem 74 compress inwardly whereby opening 76 takes on an hourglass shape (see FIG. 8A). The compressed eyelet shaped press-fit tail 70 will tend to urge outwardly against the sidewalls of the througholes to provide a strong mechanical fit with plated throughole 54: and thereby effect a strong electrical connection between the stem 74 and throughole 54. Presently, the FIGS. 5–6 embodiment of tail 74 is preferred over the FIG. 4A–C embodiment of tail 46.

Turning now to FIGS. 8–12, a connecting block in accordance with the present invention is shown generally at 52. Connecting block 52 is substantially similar to the connecting block shown in FIGS. 3–8 of U.S. Pat. No. 4,964,812 with the important difference residing in the use of beam contact 26, 44 or 70 in place of the prior art beam contacts of the type shown at 10 in FIG. 1. The use of beam contacts 26, 44 or 70 permit connector block 52 to be mounted directly into througholes on a circuit board such as beam contacts 70 mounted in the throughole 54 in circuit board 57 of FIG. 8.

In general, connector block 52 comprises a one-piece housing 52 composed of a suitable insulative material (preferably polycarbonate). Housing 52 is substantially rectangular in shape and includes a plurality of spaced apart teeth 56 and 58 along the length of its upper surface. The remaining details regarding connector 52 are found in great detail in U.S. Pat. No. 4,964,812 and reference should be made thereto for further description. The housing may or may not have stand-off ribs 59 placed along the bottom surface to facilitate solder flux removal for the clip embodiment shown in FIGS. 2 and 3.

As in the above-referenced patent, each terminal clip 26, 44 or 70 is retained within housing 52 by a pin 60 which extends through opening 38 of the terminal clip. In accordance with an important feature of this invention, the connector block 52 is assembled to terminal clips 26, 44 or 70 in accordance with a method shown in FIGS. 6A–6D of U.S. Pat. No. 4,964,812 wherein each pin is initially flash molded to housing 52 and thereafter driven through the housing 52 and opening 38 in a manner described in the '812 patent.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A connecting block for housing a plurality of insulation penetrating beam contacts, comprising:

a housing having first and second spaced apart sidewalls and opposed upper and lower ends;

a plurality of spaced apart insulation penetrating beam contacts in said housing extending between said upper and lower ends, each of said contacts having a first aperture therethrough, each of said beam contacts including a pair of beams extending from a first end of said aperture and a tail extending from a second end of said aperture opposite said first end, said tail including solderless connector means for connecting said tail into an opening through a circuit board;

a first coined section in said beams and a second coined section in said tail, said first and second coined sections being oppositely disposed to generate substantially pure axial forces during insertion of said tail in an opening through a circuit board;

a plurality of spaced openings through said second sidewalls of said housing, one of each of said openings being aligned with one each of said apertures in said beam contacts; and a plurality of spaced contact retention posts integrally molded to said first sidewall of said housing and extending laterally from said first sidewall, one of each of said posts being mutually aligned with one each of said openings and one of said apertures wherein said posts are forced under pressure to break away from said first sidewalls and are positioned through said apertures and openings to thereby retain said beam contacts within said housing.

2. The connecting block of claim 1 wherein said solderless connector means comprises:

press-fit connector means.

3. The connecting block of claim 2 wherein said press-fit connector means comprises:

a resilient eyelet shaped element.

4. The connecting block of claim 3 wherein said eyelet shaped element further comprises:

an oblong stem; and an oblong opening longitudinally through said stem and axially aligned with said stem.

5. The connecting block of claim 4 wherein said oblong stem includes:

opposed coined edges.

6. The connecting block of claim 4 wherein:

said oblong opening is deformed into an hourglass shape when said stem is press-fit through an opening in a circuit board.

7. A connecting block for housing a plurality of insulation penetrating beam contacts, comprising:

a housing having first and second spaced apart sidewalls and opposed upper and lower ends;

a plurality of spaced apart insulation penetrating beam contacts in said housing extending between said upper and lower ends, each of said contacts having a first aperture therethrough, each of said beam contacts including a pair of beams extending from a first end of said aperture and a tail extending from a second end of said aperture opposite said first end, said tail including press-fit connector means for connecting said tail to a circuit board;

said press-fit connector means comprising a resilient eyelet shaped element, said eyelet shaped element further comprising an oblong stem and an oblong opening longitudinally through said stem and axially aligned with said stem wherein, prior to said stem being press-fit through an opening in a circuit board, said oblong opening has a shape comprising opposed, parallel, elongated sidewalls of equal length which are interconnected at opposed ends thereof by a pair of opposed semi-circular end walls of equal radius and wherein said oblong opening is deformed into an hourglass shape when said stem is press-fit through an opening in a circuit board;

a plurality of spaced openings through said second sidewalls of said housing, one of each of said openings being aligned with one each of said apertures in said beam contacts; and a plurality of spaced contact retention posts, one of each of said posts being mutually aligned with one each of said openings and one of said apertures wherein said posts are positioned through said apertures and openings to thereby retain said beam contacts within said housing.

8. The connecting block of claim 7 wherein said oblong stem includes:

opposed coined edges.

9. The connecting block of claim 7 including:

a first coined section in said beams and a second coined section in said tail, said first and second coined sections being oppositely disposed to generate substantially pure axial forces during insertion of said tail in an opening through a circuit board.

10. An insulation penetrating beam contact comprising:

a flat body portion having a base;

said body portion including a pair of cantilever beams extending upwardly from said base, each beam having an upper and lower section with an elongated first opening separating said lower portions of said beams, a wire entry portion separating upper portions of said beams and an insulation displacement portion formed by said beams and positioned between said elongated first opening and said wire entry portion;

a second opening through said base;

a tail extending downwardly from said base of said flat body portion; and said tail including press-fit connector means for insertion into an opening on a circuit board, said press-fit connector means comprising a resilient eyelet shaped element, said eyelet shaped element further comprising an oblong stem and an oblong opening longitudinally through said stem and axially aligned with said item wherein, prior to said stem being press-fit through an opening in a circuit board, said oblong opening has a shape comprising opposed, parallel, elongated sidewalls of equal length which are interconnected at opposed ends thereof by a pair of opposed semi-circular end walls of equal radius and wherein said oblong opening is deformed into an hourglass shape when said stem is press-fit through an opening in a circuit board.

11. The contact of claim 10 wherein said oblong stem includes:

opposed coined edges.

12. The contact of claim 10 including:

a first coined section in said beams and a second coined section in said tail, said first and second coined sections being oppositely disposed to generate substantially pure axial forces during insertion of said tail in an opening through a circuit board.

13. A connecting block for housing a plurality of insulation penetrating beam contacts, comprising:

a housing having first and second spaced apart sidewalls and opposed upper and lower ends;

a plurality of spaced apart insulation penetrating beam contacts in said housing extending between said upper and lower ends, each of said contacts having a first aperture therethrough, each of said beam contacts including a pair of beams extending from a first end of said aperture and a tail extending from a second end of said aperture opposite said first end, said tail including press-fit connector means for connecting said tail to a circuit board;

a first coined section in said beams and a second coined section in said tall, said first and second coined sections being oppositely disposed to generate substantially pure axial forces during insertion of said tail in an opening through a circuit board;

a plurality of spaced openings through said second sidewalls of said housing, one of each of said openings being aligned with one each of said apertures in said beam contacts; and a plurality of spaced contact retention posts, one of each of said posts being mutually aligned with one each of said openings and one of said apertures wherein said posts are positioned through said apertures and openings to thereby retain said beam contacts within said housing.

14. An insulation penetrating beam contact comprising:

a flat body portion having a base;

said body portion including a pair of cantilever beams extending upwardly from said base, each beam having an upper and lower section with an elongated first opening separating said lower portions of said beams, a wire entry portion separating upper portions of said beams and an insulation displacement portion formed by said beams and positioned between said elongated first opening and said wire entry portion;

a second opening through said base;

a tail extending downwardly from said base of said flat body portion, said tail including press-fit connector means for insertion into an opening on a circuit board, the press-fit connector means comprising a resilient eyelet shaped element; and a first coined section is said beams and a second coined section in said tail, said first and second coined sections being oppositely disposed to generate substantially pure axial forces during insertion of said tail in an opening through a circuit board.

* * * * *

UNITED STATES PATENT AND TRADEMARK OFFICE

CERTIFICATE OF CORRECTION

PATENT NO. : 5,645,445

DATED : July 8, 1997

INVENTOR(S) : John A. Siemon, et al

It is certified that error appears in the above-identified patent and that said Letters Patent is hereby corrected as shown below:

Column 4, line 57, insert new paragraph between "board." and "One".
Column 4, line 63, delete "40" and insert therefor --44--.
Column 10, line 1, delete "is" and insert therefor --in--.

Signed and Sealed this

Fourth Day of April, 2000

*Attest:*

*Attesting Officer*

Q. TODD DICKINSON

*Director of Patents and Trademarks*